US008621994B2

(12) United States Patent
Shih

(10) Patent No.: US 8,621,994 B2
(45) Date of Patent: Jan. 7, 2014

(54) EMBOSSER

(75) Inventor: Hsu-Shen Shih, Tainan (TW)

(73) Assignee: Sun Same Enterprises Co., Ltd., Tainan (TW)

( * ) Notice: Subject to any disclaimer, the term of this patent is extended or adjusted under 35 U.S.C. 154(b) by 376 days.

(21) Appl. No.: 12/954,609

(22) Filed: Nov. 24, 2010

(65) Prior Publication Data

US 2012/0037015 A1 Feb. 16, 2012

(30) Foreign Application Priority Data

Aug. 13, 2010 (TW) ..... 99215529 U
Nov. 9, 2010 (TW) ..... 99221662 U

(51) Int. Cl.
*B44B 5/00* (2006.01)
*B41K 3/36* (2006.01)

(52) U.S. Cl.
USPC ..... 101/31.1; 100/234

(58) Field of Classification Search
CPC .... B44B 5/0085; B44B 5/0038; B44B 5/026; B44B 5/0023
USPC ..... 101/31.1; 100/234, 281, 291, 293, 283
See application file for complete search history.

(56) References Cited

U.S. PATENT DOCUMENTS

| | | | | |
|---|---|---|---|---|
| 1,471,687 A | | 10/1923 | Eyman | |
| 1,512,476 A | | 10/1924 | Meyer | |
| 1,590,976 A | | 6/1926 | Hasselquist | |
| 1,658,823 A | * | 2/1928 | Willard | 101/31.1 |
| 2,077,853 A | * | 4/1937 | Priesmeyer | 101/31.1 |

FOREIGN PATENT DOCUMENTS

JP 2003275997 A * 9/2003

OTHER PUBLICATIONS

European Serach Report (Application No. 11166166.6), Dec. 23, 2011.

* cited by examiner

*Primary Examiner* — Daniel J Colilla
*Assistant Examiner* — Leo T Hinze
(74) *Attorney, Agent, or Firm* — Su IP Consulting

(57) ABSTRACT

Embodiments of the disclosure set forth an embosser for a die. The embosser includes a frame, a roller body, and a handle. The frame includes two substantially parallel sides. The roller body includes a roller to be in contact with the die. The embosser further includes a first pin pivotally coupling an end of the handle to the sides of the frame, and a second pin pivotally coupled the handle to a first end of the roller body. The second pin further couples the first end of the roller body to the sides of the frame along a first path. The embosser further includes a third pin coupling a second end of the roller body to the sides of the frame along a second path.

27 Claims, 5 Drawing Sheets

EMBOSSER

CROSS-REFERENCE TO RELATED APPLICATIONS

This application claims priority to Taiwan Application No. 099215529 filed on Aug. 13, 2010 and Taiwan Application No. 099221662 filed on Nov. 9, 2010. Each of the Taiwan applications is hereby incorporated by reference in its entirety.

BACKGROUND OF THE DISCLOSURE

An embosser is commonly used by corporations, government offices, and notary publics. The embosser typically includes a frame, a handle pivotally coupled to the frame, and a roller coupled to the handle. A die is inserted into the frame and under the roller, and a piece of paper is inserted into the die. When the handle is depressed, it drives the roller down on the die to create a three-dimensional image or design on the paper.

SUMMARY OF THE DISCLOSURE

Embodiments of the disclosure set forth an embosser for a die. The embosser includes a frame, a roller body, and a handle. The frame includes two substantially parallel sides. The roller body includes a roller for pressing down on the die. The embosser further includes a first pin pivotally coupling an end of the handle to the sides of the frame, and a second pin pivotally coupling the handle to a first end of the roller body. The second pin further couples the first end of the roller body to the sides of the frame along a first path. The embosser further includes a third pin coupling a second end of the roller body to the sides of the frame along a second path.

Embodiments of the disclosure set forth an embosser for a die. The embosser includes a frame, a handle, and a roller body. The handle is coupled by a first pin-in-slot joint to the frame. The roller body includes a roller for pressing down on the die. The roller body is coupled by a pin joint to the handle. Two ends of the roller body are also coupled by second and third pin-in-slot joints to the frame.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

Figure 1A:
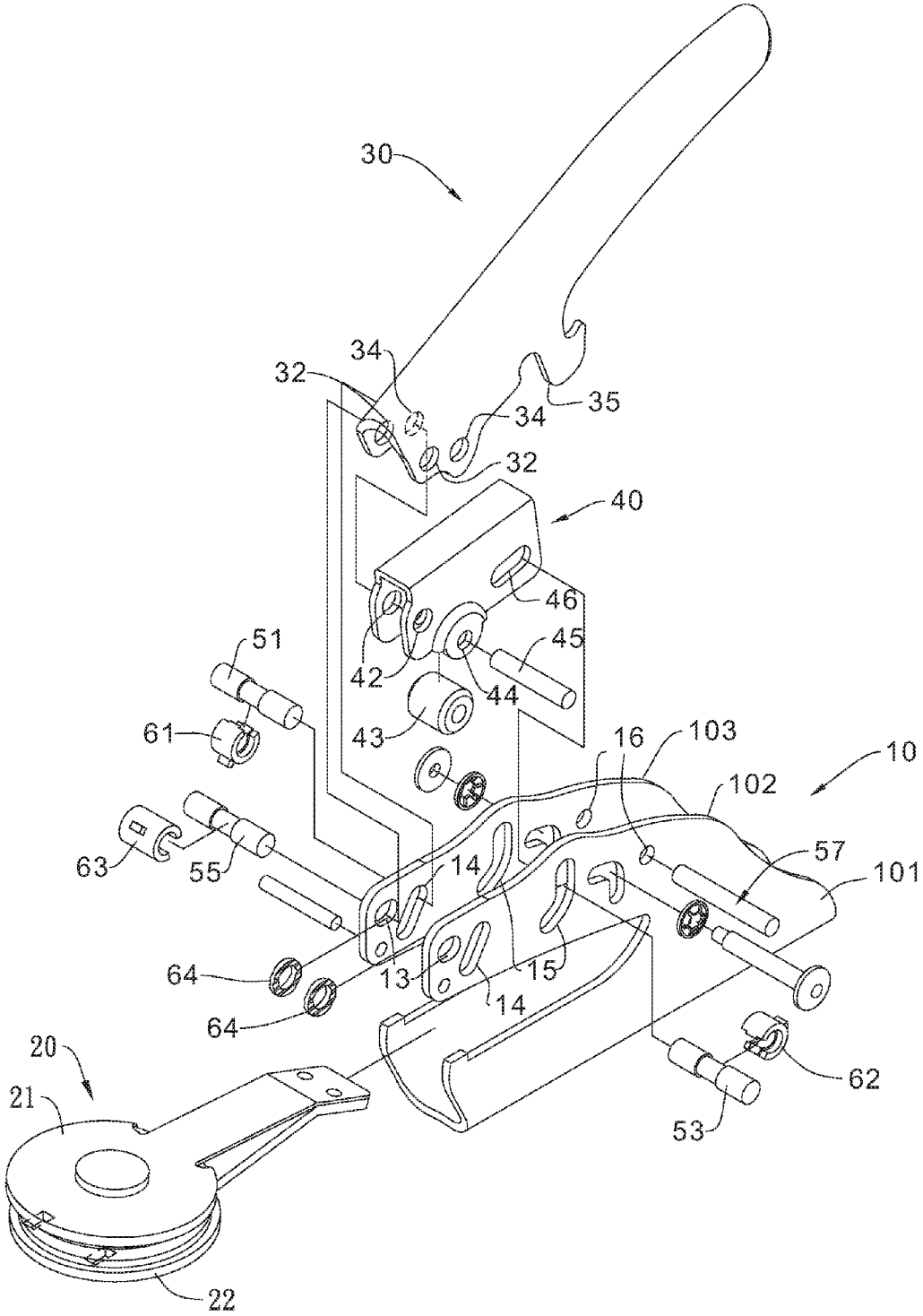
FIG. 1A is an exploded view of an embosser for a die.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here. It will be readily understood that the aspects of the present disclosure, as generally described herein, and illustrated in the figures, can be arranged, substituted, combined, and designed in a wide variety of different configurations, all of which are explicitly contemplated and make part of this disclosure.

In one or more embodiments of the present disclosure, an embosser includes a handle, a roller body, and a frame. The handle is pivotally coupled to the frame and linked to one end of the roller body. The handle can also contact another end of the roller body. When the handle is depressed, it pushes down on the two ends of the roller body and the roller body presses down on a die to make a three-dimensional image or design on a piece of material.

Figure 1B:
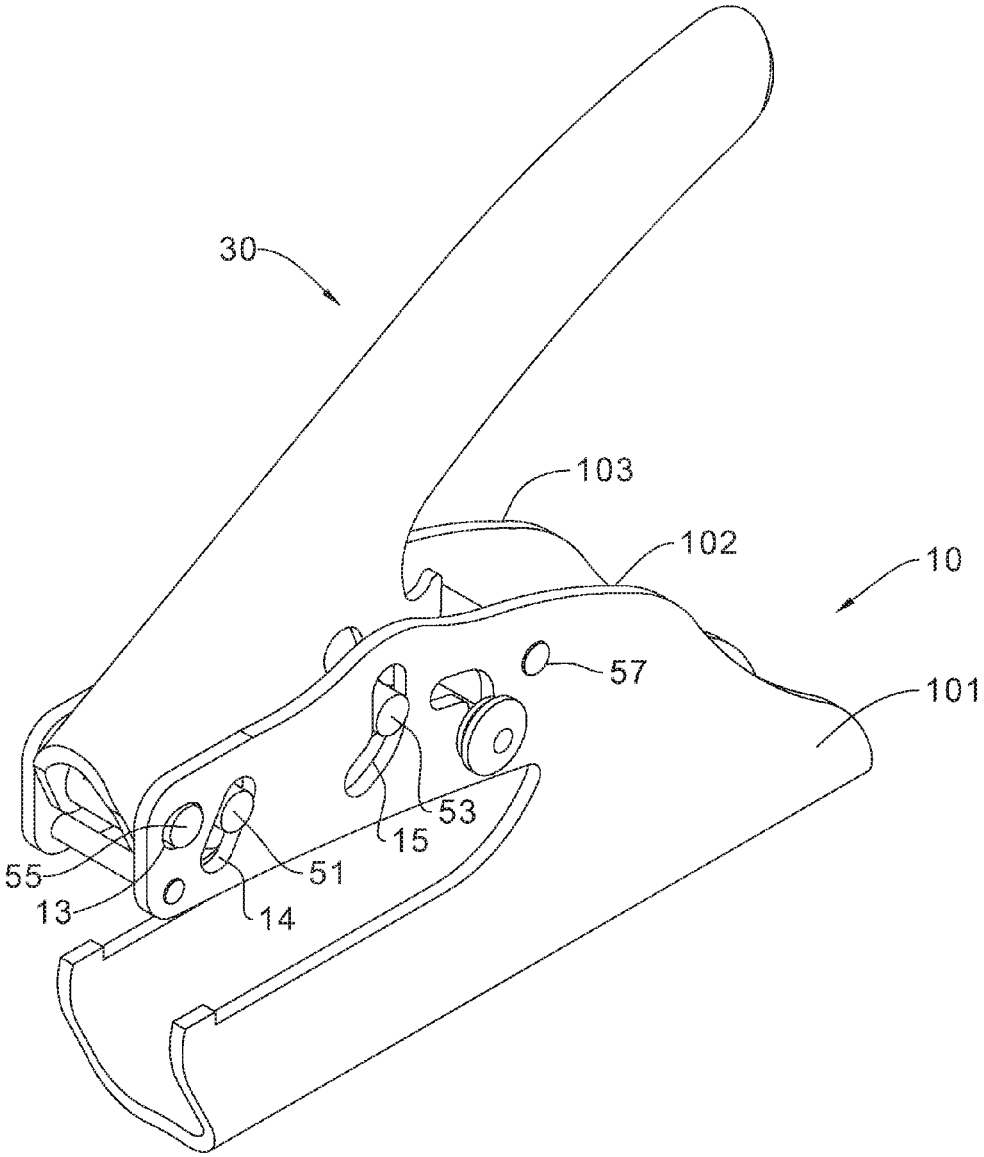
FIG. 1B is an assembled view of the embosser of FIG. 1A.

FIG. 1A is an exploded view of an embosser 100 for a die 20, and FIG. 1B is an assembled view of the embosser 100, in accordance with one or more embodiments of the disclosure. The embosser 100 includes a frame 10, a handle 30, and a roller body 40. The roller body 40 generally fits in the front portion of the handle 30, and the front portion of the handle 30 with the roller body 40 generally fits in the front portion of the frame 10.

The frame 10 includes two parallel vertical sides 101 and 103. The sides 101 and 103 define a pair of symmetrical frame slots 13, a pair of symmetrical frame slots 14, a pair of symmetrical frame slots 15, and a pair of symmetrical frame holes 16. The frame slots 13, 14, 15 and frame holes 16 are generally located along the length of the frame 100 from the front to the back.

The roller body 40 includes to two parallel vertical sides. The sides define a pair of symmetrical roller body holes 42, a pair of symmetrical roller body holes 44, and a pair of symmetrical roller body slots 46. The roller body holes 42, 44 and the roller body slots 46 are generally located along the length of the roller body 40 from the front to the back. A roller body pin 45 secures a roller 43 to the roller body 40 through the roller body holes 44.

A roller body pin 53 is inserted through the frame slots 15 and the roller body slots 46 to couple the mid portion of the frame 10 to the back end of the roller body 40, thereby forming a pin-in-slot joint between the mid portion of the frame 10 and the back end of the roller body 40. When the handle 30 is depressed to press down on the roller body pin 53, the back end of the roller body 40 moves along a path defined by the frame slots 15 and the roller body slots 46. In some implementations, the frame slots 15 are curved diagonally, and the roller body slots 46 are linearly horizontal.

The handle 30 defines a pair of symmetrical handle holes 32 and a pair of symmetrical handle holes 34. The handle holes 32 and 34 are generally located along the length of the handle 30 from the front to the back. A handle pin 55 pivotally couples the front end of the handle 30 to the front end of the frame 10 through the handle holes 32 and the frame slots 13, thereby forming a pin-in-slot joint between the front end of the handle 30 and the front end of the frame 10. When the handle 30 is depressed, the front end of the handle 30 moves along a path defined by the frame slots 13. In some implementations, the frame slots 13 are linearly horizontal.

A handle pin 51 pivotally couples the front end of the handle 30 to the front end of the roller body 40 through the handle holes 34 and the roller body holes 42, thereby forming a pin joint between the front end of the handle 30 and the front end of the roller body 40. The handle pin 51 further couples the front end of the roller body 40 to the front end of the frame 10 through the roller body holes 42 and the frame slots 14, thereby forming a pin-in-slot joint between the front end of the roller body 40 and the front end of the frame 10. When the handle 30 is depressed, the front end of the roller body 40 moves along a path defined by the frame slots 14. In some implementations, the frame slots 14 are linearly diagonal.

The pins 51, 53, and 55 may have grooves, so they may be secured by retaining rings or circlips 61, 62, and 63, respectively. In some implementations, the two ends of the pin 55 may be secured by additional retaining rings or circlips 64.

The embosser 100 further includes a frame pin 57. The frame pin 57 is inserted through and secured to the frame holes 16.

In operation, a die 20 is inserted into a front opening defined by the sides 101 and 103. The die 20 may include an upper die 21 and a lower die 22. The upper die 21 is positioned under and in contact with the roller 43. The lower die 22 is seated against the bottom of the front opening provided by the sides 101 and 103. When the handle 30 is depressed, the roller 43 presses the upper die 21 down on the lower die 22 to form a three-dimensional image or design on a material disposed between the upper die 21 and the lower die 22.

Figure 2A:
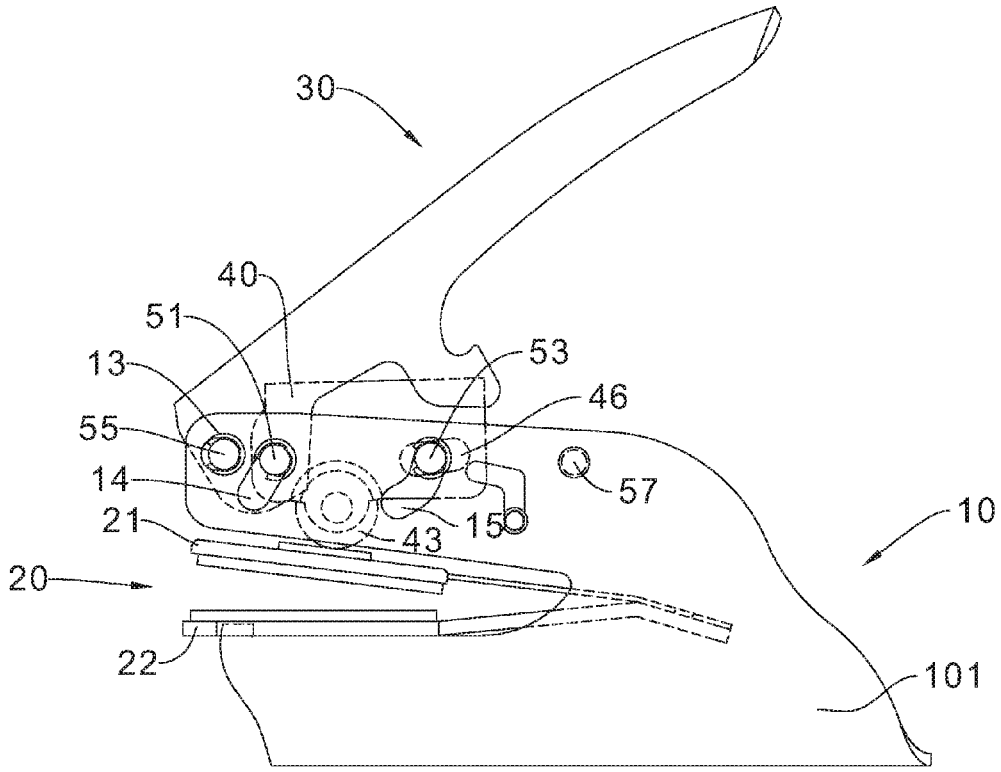
FIG. 2A is a side view of the embosser of FIG. 1B in an initial position.

FIG. 2A is a side view of embosser 100 at an initial position in accordance with one or more embodiments of the disclosure. In FIG. 2A, no force is applied to the handle 30, and the handle 30 is at an initial position. The handle pin 55 is at or near the back end of the frame slots 13. The handle pin 51 is at or near the top end of the frame slots 14. The roller body pin 53 is at or near the top end of the frame slots 15 and at a first mid position near the back end of the roller body slots 46. The handle 30 is currently not in contact with the roller body pin 53.

Figure 2B:
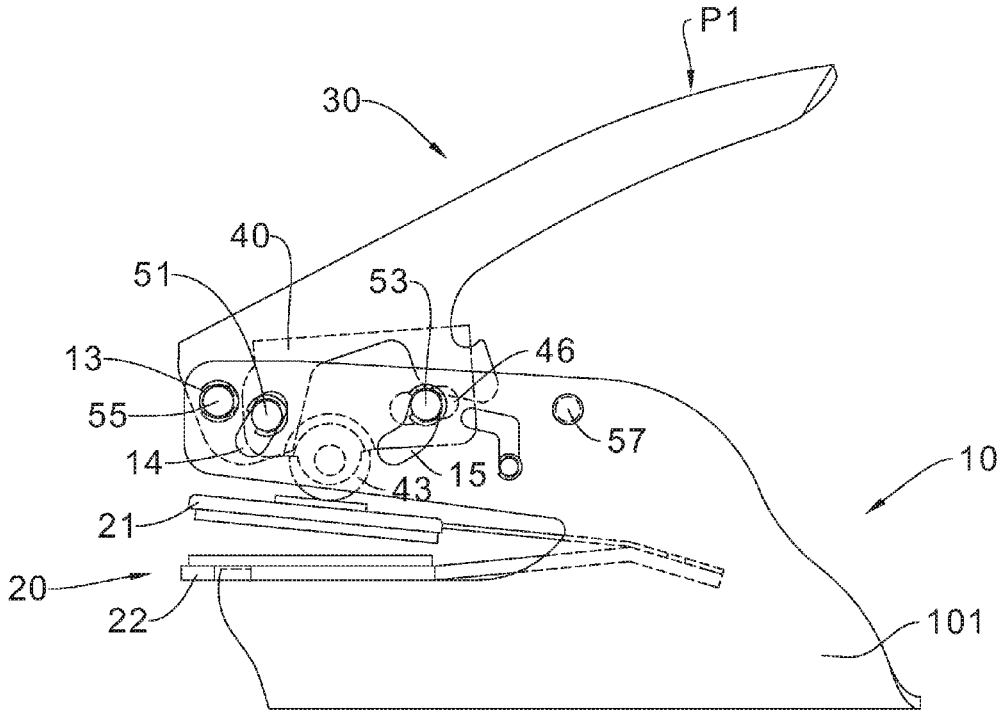
FIG. 2B is a side view of the embosser of FIG. 1B in an intermediate position.

FIG. 2B is a side view of embosser 100 at an intermediate position in accordance with one or more embodiments of the disclosure. In FIG. 2B, a force P1 is applied to the handle 30, and the handle 30 pivots to an intermediate position. The handle 30 is now in contact with the roller body pin 53. The handle pin 55 is at or near a mid position in the frame slots 13. The handle pin 51 is at or near a mid position in the frame slots 14. The roller body pin 53 is still at or near the top end of the frame slots 15 and at the first mid position of the roller body slots 46. The roller body 40 drives the roller 43 to press down on the upper die 21 so that the upper die 21 moves toward the lower die 22.

Figure 2C:
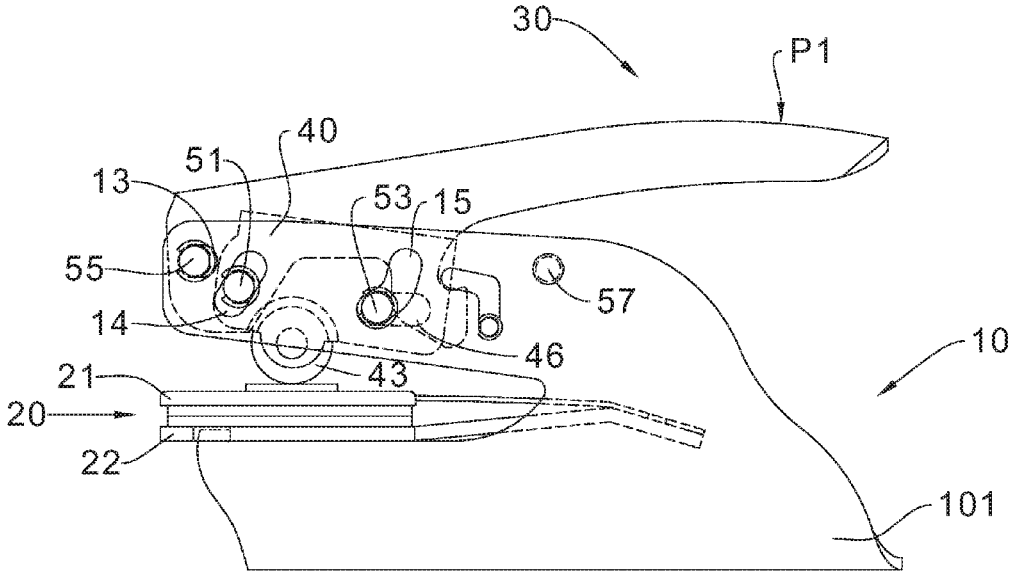
FIG. 2C is a side view of the embosser of FIG. 1B in a final position, all arranged in accordance with some embodiments of the disclosure.

FIG. 2C is a side view of embosser 100 at a final position in accordance with one or more embodiments of the disclosure. In FIG. 2C, the force P1 continues to apply to the handle 30, and the handle 30 pivots to a final position. The handle 30 maintains contact with the roller body pin 53. The handle pin 55 is at or near the front end of the frame slots 13. The handle pin 51 is near the bottom end of the frame slots 14. The roller body pin 53 is near the bottom end of the frame slots 15. The roller body pin 53 is also at a second mid position near the front end of the roller body slots 46, where the second mid position is closer to the front end of the roller body slots 46 than the first mid position. The upper die 21 is now pressed against the lower die 22. When the force P1 is released, the handle pins 55, 51 and the roller body pin 53 all return to their initial positions set forth above and shown in FIG. 2A.

Referring to FIGS. 2A, 2B, and 2C, the handle pin 55 moves from the back end of the frame slots 13 to the front end of the frame slots 13, the handle pin 51 moves from the top end of the frame slots 14 to the bottom end of the frame slots 14, and the roller body pin 53 moves from the top end of the frame slots 15 to a position near the bottom end of the frame slots 15. The movements of the handle pin 55, the handle pin 51, and the roller body pin 53 drive the roller body 40 to move forward and downward to press the upper die 21.

The arrangement of the handle pin 55, 51 and the roller body pin 53 requires less force to be applied to the handle 30 to make a three-dimensional image or design on a material between the upper die 21 and the lower die 22.

From the foregoing, it will be appreciated that various embodiments of the present disclosure have been described herein for purposes of illustration, and that various modifications may be made without departing from the scope and spirit of the present disclosure. Accordingly, the various embodiments disclosed herein are not intended to be limiting, with the true scope and spirit being indicated by the following claims.

I claim:

1. An embosser for a die, the embosser comprising:
- a frame comprising two substantially parallel sides;
- a roller body including a roller to be in contact with the die;
- a handle;
- a first pin pivotally coupling an end of the handle to the sides of the frame;
- a second pin pivotally coupling the handle to a first end of the roller body and further coupling the first end of the roller body to the sides of the frame, wherein the second pin is movable along a first pair of slots defined by the two sides of the frame; and
- a third pin coupling a second end of the roller body to the sides of the frame, wherein the third pin is movable along a second pair of slots defined by the roller body.

2. The embosser of claim 1, wherein the second pair of slots is substantially linear and horizontal.

3. The embosser of claim 1, wherein the third pin is further movable along a third pair of slots defined by the two sides of the frame.

4. The embosser of claim 3, wherein the third pair of slots is substantially curved and diagonal.

5. The embosser of claim 1, wherein the handle is not in contact with the third pin when the handle is at a first position.

6. The embosser of claim 5, wherein the handle contacts the third pin when the handle moves to a second position.

7. The embosser of claim 6, wherein the handle has a substantially curved profile configured to be in contact with the third pin.

8. The embosser of claim 1, wherein the first pair of slots is substantially linear and diagonal.

9. An embosser for a die, the embosser comprising:
- a frame comprising two substantially parallel vertical sides;
- a handle coupled by a first pin-in-slot joint to the frame; and
- a roller body including a roller to be in contact with the die, the roller body being coupled by a pin joint to the handle, two ends of the roller body being coupled by a second pin-in-slot joint and a third pin-in-slot joint to the frame, wherein the third pin-in-slot joint is movable along a fourth pair of slots defined by the two sides of the frame.

10. The embosser of claim 9, wherein the first pin-in-slot joint is movable along a first pair of slots defined by the two sides of the frame.

11. The embosser of claim 10, wherein the first pair of slots is substantially linear and horizontal.

12. The embosser of claim 10, wherein the second pin-in-slot joint is movable along a second pair of slots defined by the two sides of the frame, and the pin joint and the second pin-in-slot joint share a pin.

13. The embosser of claim 12, wherein the second pair of slots is substantially linear and diagonal.

14. The embosser of claim 12, wherein the third pin-in-slot joint is movable along a third pair of slots defined by the roller body.

15. The embosser of claim 9, wherein the third pair of slots is substantially linear and horizontal.

16. The embosser of claim 9, wherein the fourth pair of slots is substantially curved and diagonal.

17. The embosser of claim 9, wherein the handle is not in contact with the second pin-in-slot joint when the handle is at a first position.

18. The embosser of claim 9, wherein the handle contacts a pin from the third pin-in-slot joint when the handle is at a second position.

19. The embosser of claim 18, wherein the handle has a substantially curved profile configured to be in contact with the pin.

20. An embosser for a die, the embosser comprising:

a frame comprising two substantially parallel sides;

a roller body including a roller to be in contact with the die;

a handle;

a first pin pivotally coupling an end of the handle to the sides of the frame;

a second pin pivotally coupling the handle to a first end of the roller body and further coupling the first end of the roller body to the sides of the frame, wherein the second pin is movable along a first pair of slots defined by the two sides of the frame; and a third pin coupling a second end of the roller body to the sides of the frame, wherein the third pin is movable along a second pair of slots defined by the two sides of the frame.

21. The embosser of claim 20, wherein the first pair of slots is substantially linear and diagonal.

22. The embosser of claim 20, wherein the second pair of slots is substantially curved and diagonal.

23. The embosser of claim 20, wherein the third pin is further movable along a third pair of slots defined by the roller body.

24. The embosser of claim 23, wherein the third pair of slots is substantially linear and horizontal.

25. The embosser of claim 20, wherein the handle is not in contact with the third pin when the handle is at a first position.

26. The embosser of claim 25, wherein the handle contacts the third pin when the handle moves to a second position.

27. The embosser of claim 26, wherein the handle has a curved profile configured to be in contact with the third pin.

* * * * *